US008155361B2

(12) United States Patent
Schindler

(10) Patent No.: US 8,155,361 B2
(45) Date of Patent: Apr. 10, 2012

(54) INSERTION DEVICE FOR DEEP-IN-THE-CANAL HEARING DEVICES

(75) Inventor: Robert A. Schindler, San Francisco, CA (US)

(73) Assignee: InSound Medical, Inc., Newark, CA (US)

( * ) Notice: Subject to any disclaimer, the term of this patent is extended or adjusted under 35 U.S.C. 154(b) by 572 days.

(21) Appl. No.: 12/335,445

(22) Filed: Dec. 15, 2008

(65) Prior Publication Data

US 2010/0142739 A1 Jun. 10, 2010

Related U.S. Application Data

(60) Provisional application No. 61/119,971, filed on Dec. 4, 2008.

(51) Int. Cl.
*H04R 25/00* (2006.01)

(52) U.S. Cl. ..... 381/329; 181/130; 181/135; 381/322; 381/328

(58) Field of Classification Search ..... 181/129, 181/130, 135; 381/312, 322, 328, 329; 600/25; 607/57

See application file for complete search history.

(56) References Cited

U.S. PATENT DOCUMENTS 3,967,224 A 6/1976 Seeley
4,039,985 A 8/1977 Shlesinger, Jr. et al.
4,412,096 A * 10/1983 Edgerton et al. ..... 381/60
4,628,907 A 12/1986 Epley
4,756,312 A 7/1988 Epley
4,803,458 A 2/1989 Trine et al.
4,817,609 A 4/1989 Perkins et al.
4,845,755 A 7/1989 Busch et al.
4,918,736 A 4/1990 Bordewijk
4,947,432 A 8/1990 Topholm
5,003,608 A * 3/1991 Carlson ..... 381/329
5,128,641 A 7/1992 Posey
5,131,411 A 7/1992 Casali et al.
5,233,322 A 8/1993 Posey
(Continued)

OTHER PUBLICATIONS

International Search Report and Written Opinion of PCT Application No. PCT/US2008/086867, mailed Sep. 3, 2009, 18 pages total.

*Primary Examiner* — Allan R Wilson
(74) *Attorney, Agent, or Firm* — Henricks, Slavin & Holmes LLP

(57) ABSTRACT

The invention provides a device and method for inserting a deep-in-the-ear-canal (DIC) hearing aid into the ear canal. The method may be performed by a DIC hearing aid user self-inserting the hearing aid or by a second person assisting the user. Embodiments of a DIC hearing aid insertion device include a base configured to fit into the conchal cavity of an ear, a chimney configured to fit into the ear canal projecting distally from the base and having a channel sized for a DIC hearing aid, and a piston. The piston is supported by a support structure such that the piston's longitudinal axis is collinear with the channel and the piston is moveable into the channel. A method of using the insertion device includes seating the DIC hearing aid in the insertion device, positioning the base of the insertion conformably within the conchal bowl of the ear, and inserting the hearing aid deep into the ear canal. Other embodiments of the invention are directed to in situ activation and programming of the DIC hearing aid, as well as its removal from the ear canal.

38 Claims, 10 Drawing Sheets

U.S. PATENT DOCUMENTS 5,293,523 A 3/1994 Posey
5,303,306 A 4/1994 Brillhart et al.
5,359,321 A 10/1994 Ribic
5,390,254 A 2/1995 Adelman
5,553,152 A 9/1996 Newton
5,659,621 A 8/1997 Newton
5,701,348 A 12/1997 Shennib et al.
5,796,254 A 8/1998 Andrus
5,811,896 A 9/1998 Grad
6,055,319 A * 4/2000 Shennib et al. ..... 381/328
6,940,988 B1 9/2005 Shennib et al.
7,016,511 B1 3/2006 Shennib
7,215,789 B2 5/2007 Shennib et al.
7,310,426 B2 12/2007 Shennib et al.
7,388,961 B2 6/2008 Shennib et al.
7,555,135 B1 * 6/2009 Harb ..... 381/329
7,720,243 B2 * 5/2010 Brumback et al. ..... 381/328
7,913,696 B2 * 3/2011 Purcell et al. ..... 128/864
2008/0144871 A1 * 6/2008 Purcell et al. ..... 381/329

* cited by examiner

INSERTION DEVICE FOR DEEP-IN-THE-CANAL HEARING DEVICES

CROSS REFERENCE TO RELATED APPLICATIONS

This application claims priority to U.S. Provisional Patent Application No. 61/119,971 of Schindler, entitled "Insertion Device for Deep-in-the-Canal Hearing Devices", as filed on Dec. 4, 2008, the disclosure of which is incorporated by reference as if fully set forth herein.

FIELD OF THE INVENTION

The present invention relates to devices that facilitate the placement or insertion of hearing aid devices into the ear. More particularly, the invention relates devices that place deep-in-the-canal hearing aids deeply in the ear canal, and still more particularly, the invention relates to placement devices that can be used by the hearing aid wearer or by a second person assisting the wearer.

INCORPORATION BY REFERENCE

All publications, patents and patent applications mentioned in this specification, either by inventors common to this application or other inventors, are herein incorporated by reference to the same extent as if each individual publication, patent, or patent application was specifically and individually indicated to be incorporated by reference.

BACKGROUND OF THE INVENTION

Hearing devices that reside deep in the canal (DIC), such as the Lyric device (InSound Medical Inc., Newark Calif.) represent a major step forward in the development of hearing aids from several perspectives. Their sound quality is very high, they are effectively invisible from an external perspective, and they can reside in place for a period of several months, the residence time limit determined, in major part, by the lifetime of the battery. DIC hearing aids differ from completely-in-the-canal (CIC) hearing aids. CIC hearing aids are larger than DIC hearing aids, and reside in the outer cartilaginous portion of the ear canal, and are typically placed in the ear and removed on a daily basis. In contrast, DIC hearing aids are placed deep in the ear canal, in the bony portion of the canal very near the tympanic membrane, and can reside in that site for several months. A major factor limiting residence time is the lifetime of the battery, and as improvements in batteries extend their life, so too will lengthen the residence time of DIC hearing aids. A description of an exemplary DIC device is provided by U.S. Pat. No. 7,310,426 of Shennib, et al. (issued on Dec. 18, 2007).

A limiting factor in their ease of use and general marketability of DIC devices, however, is the fact that presently they must be inserted by a health care professional or by an individual trained in their insertion by a health care professional. Although a user can remove a DIC device with an instrument such as that described in U.S. Pat. No. 7,388,961 of Shennib, self-insertion of a device simply is not currently feasible. Insertion by a healthcare professional is necessitated by several factors, including the difficulty in handling such a small device without an instrument, the vulnerability of the hearing aid to breakage with mishandling, the impracticality of handling conventional insertion instruments without visual guidance, and the importance of not placing the hearing aid too deeply in the ear canal.

A device that allows self-insertion of deep-in-the-ear hearing aids would contribute to significantly to general acceptance and use of these DIC hearing aids in the market.

SUMMARY OF THE INVENTION

Embodiments of the present invention include systems, devices, and methods related to the insertion and removal of deep-in-the-canal hearing aids. A device for inserting a deep-in-the-canal (DIC) hearing aid includes a base or platform portion configured to fit into the conchal cavity of an ear; a chimney projecting distally from the base, and a piston supported by a support structure or cover portion of the device. More particularly, it is the exterior and distal surface of the insertion device that conforms to the conchal cavity of an ear. The chimney is configured to fit into the ear canal and includes a channel that is sized to accommodate a deep-in-the-canal hearing aid. The piston is supported by the support structure in such a manner that the central longitudinal axis of the piston is collinearly aligned with the central longitudinal axis of the channel within the chimney, and the piston is distally moveable into the channel.

In various embodiments, the height of the chimney is about 2.5 mm to about 10 mm above the distal surface of the base; in particular embodiments, the height is about 3 mm to about 7 mm above the distal surface of the base. These heights correspond to the approximate depth to which the distal surface of the chimney penetrates into the ear canal, when the device is positioned in the ear. The channel of the chimney includes a distal opening that is sized to permit through passage of the deep-in-the-canal hearing aid. In some embodiments, the channel of the chimney includes a proximal raised receptacle portion projecting into the internal space between the base platform and the cover, which is sized to accommodate the piston. The internal surface of the channel includes a material that is sufficiently compliant to compressibly secure a hearing aid within the channel and sufficiently low in frictional resistance to allow passage of the hearing aid therethrough in response to finger pressure force which is typically applied by a user when inserting the device.

In typical embodiments of the DIC hearing aid inserter, the piston structure includes an actuator adapted to move the piston distally into the channel. One example of an actuator is that of a button on a proximal surface of the support structure adjacent to a proximal base of the piston which a user simply presses with a finger, thereby driving the piston distally such that it meets the proximal surface of a DIC hearing aid that is seated in the channel.

In some embodiments of the DIC hearing aid insertion device, the piston support structure take the form of a device cover, and the cover and the base or platform of the device define a cavity within the insertion device, the insertion device thus having a capsule-like aspect that secures the DIC hearing aid within. In some embodiments, piston support and the base include or are formed of a compliant and resilient material such that the support may be pressed toward the base by finger pressure, thus substantially collapsing the cavity or the capsule.

It is advantageous in the operation of the insertion device, that the extent of movement of the piston, more particularly, the distance to which the piston pushes a DIC hearing aid into the ear canal be well-controlled and limited to particular specifications. Thus, some embodiments of the device include features that cooperate to provide a limit to the advancement of the piston into the channel, such features being associated with any one or more of the piston support structure, the piston, or the channel. In one example of features cooperate to form a movement stop, the channel includes a raised receptacle wall portion that contiguously extends the channel proximally above the base, and the piston support structure includes an abutting surface adjacent to a proximal portion of the piston; the wall and piston support structure surface are aligned such that the abutting surface and receptacle wall meet when the piston support structure is advanced toward the base. In another example of features that cooperate to form a movement stop, an external aspect of the piston and an internal aspect of the channel are mutually configured such that the distance of distal movement of the piston into the channel is limited. For example, the piston may include a raised annular portion while the channel includes an abutting surface with an internal diameter that is smaller than an external diameter of the raised annular portion.

Some embodiments of the piston are rigid, while other embodiments are flexible. Some embodiments of the insertion device include a piston movement resister element which prevents inadvertent or premature movement of the piston and consequent movement of the DIC hearing aid. The resister element provides a resistance that can be easily overcome with a normal and intended application of finger pressure. The insertion device may further include finger-engaging elements such as tabs, which facilitate easy and controlled handling of the device.

Some embodiments of the device include a protective membrane arranged across the distal opening of the channel. The membrane is breakable when it is pressed by the DIC hearing aid as it is ejected from the channel during normal operation of the device by finger pressure applied by a user.

Some embodiments of DIC hearing aid insertion device are pre-loaded with a hearing aid, thus including a DIC hearing aid seated in the channel such that a distal end of the hearing aid is aligned with the external opening of the channel. In another aspect, therefore, a device preloaded with a DIC hearing aid may be considered a system for insertion of a DIC hearing aid into an ear canal. Such a system includes a base configured to fit into the conchal cavity of an ear; a DIC hearing aid; a chimney projecting distally from the base, the chimney configured to fit into the ear canal and comprising a channel with the DIC hearing aid seated therein; and a piston supported by a support structure such that a central longitudinal axis of the piston and a central longitudinal axis of the channel are collinearly aligned, the piston being distally moveable into the channel.

The present invention also provides a method of inserting a deep-in-the-canal (DIC) hearing aid into an ear canal which includes seating the DIC hearing aid within an insertion device, positioning the insertion device conformably within a conchal bowl of an ear; and advancing the DIC hearing aid deep into the ear canal. In typical embodiments, positioning the insertion device in the conchal bowl further includes positioning a portion of the device into the ear canal. More particularly, positioning that portion into the ear canal includes positioning the distal end of the device into the ear canal to a depth of about 3 mm to about 5 mm. In various embodiments, the method of inserting a DIC hearing aid into the ear canal may be performed either by the hearing aid user, in a self-inserting manner, or by a second person assisting the hearing aid user.

The advancing step, whereby the hearing aid is advanced from its seated position within the insertion device to an appropriate site deep within the ear canal includes various aspects. In some embodiments, the advancing step includes driving the hearing aid distally with a piston. In some of these embodiments, driving the hearing aid distally with a piston includes driving the piston with force applied by a finger. In some embodiments, the advancing step includes breaking a membrane that extends across a distal opening of the device. In some embodiments, the inserting step comprises ejecting the hearing aid to clear a distal end of the device. In some embodiments, the advancing step includes advancing the hearing aid into the ear canal to a depth such that a distal end of the hearing aid is within about 4 mm from a tympanic membrane. More particularly, some of these embodiments include advancing the hearing aid into the ear canal to a depth such that a distal end of the hearing aid is about 2 mm to about 4 mm from the tympanic membrane. In some embodiments, the advancing step includes stopping advancement of the hearing aid into the ear canal to a depth such that it does not press into a tympanic membrane. In other embodiments, the advancing step includes resisting advancement of the hearing aid into the ear canal with a resisting force sufficient to prevent unintentional advancement; and advancing the hearing aid into the canal with a force sufficient to overcome the resisting force.

In another aspect, the present invention provides a method of packaging a deep-in-the-canal (DIC) hearing aid which includes seating the DIC hearing aid in an DIC hearing insertion device as has been summarized above, and closing the base and the support structure of the insertion device together. In some of these packaging embodiments, the method further includes attaching the base and the support structure of the insertion device together. Packaging embodiments may further include applying a membrane across the distal opening of the channel of the device.

In another aspect, the present invention provides a method of selecting an insertion device for a deep-in-the-canal (DIC) hearing aid on a patient-specific basis. Embodiments of this method include determining a length of an ear canal of a hearing aid user, identifying the length of the DIC hearing aid appropriate for a user; and then selecting a device configured such that the insertion device will advance the hearing aid into the ear canal to a position where the distal end of the hearing aid is at a distance of about 2 mm to about 4 mm from the tympanic membrane.

In another aspect of the invention, a platform for a removal device, to remove a deep-in-the-canal (DIC) hearing aid from within an ear canal, is provided. Embodiments of this platform include a distal surface configured to fit into the conchal cavity of an ear, and a chimney projecting distally from the distal surface of platform. The chimney is configured to fit into a canal of the ear and includes a channel sized to accommodate a deep-in-the-canal hearing aid removal device. In a related aspect, the invention provides a system for removal of a deep-in-the-canal (DIC) hearing aid from within an ear canal. This system includes a platform and distally-directed chimney as just summarized, and a DIC hearing aid removal device. Another related aspect of the invention is thus a method that makes use of the system to remove a DIC hearing aid from an ear canal. Such method includes positioning a platform for a DIC hearing aid removal device conformably within the conchal bowl of an ear, inserting at least a portion of a DIC hearing aid removal tool channel through the platform and into the ear canal, detachably engaging the DIC hearing aid removal tool to the DIC hearing aid, and withdrawing the removal tool from the ear canal with the hearing aid attached thereto.

In another aspect of the invention, a platform for an electromagnetic activation device for a deep-in-the-canal (DIC) hearing aid residing in an ear canal is provided. Embodiments of this platform include a distal surface configured to fit into the conchal cavity of an ear and a chimney projecting distally from the distal surface of platform. The chimney is configured to fit into a canal of the ear and includes a channel sized to accommodate the DIC hearing aid electromagnetic activation device. In a related aspect, the invention provides a system for the activation of a deep-in-the-canal (DIC) hearing aid residing within an ear canal. Embodiments of this system include a platform for an electromagnetic activation device for a deep-in-the-canal (DIC) hearing aid residing in an ear canal (as just summarized) and a DIC hearing aid electromagnetic activation device. Another related aspect of the invention is thus a method that makes use of the system to activate a DIC hearing aid as it resides in an ear canal. Such method includes positioning a platform for a DIC hearing aid electromagnetic activation device conformably within the conchal bowl of an ear, inserting at least a portion of a DIC hearing aid electromagnetic activation device through the platform and into the ear canal, and transmitting an electromagnetic activating signal to the DIC hearing aid.

BRIEF DESCRIPTION OF THE FIGURES

FIG. 8B shows the device in an open or expanded configuration. FIG. 8C shows the device in a compressed configuration such that the piston extends distally from the base.

FIG. 9A shows a proximal-looking perspective view of an embodiment of a chimney of a base portion of an insertion device with a protective membrane covering the opening and the hearing aid seated in the opening.

FIG. 9B shows the chimney of FIG. 9A after the DIC hearing aid has been pushed out of the chimney by a piston, and while emerging from the chimney, the hearing aid has broken the membrane, leaving remnant membrane attached to the chimney.

FIG. 9C shows a perspective view of the distal end of the chimney showing the presence of relaxation cuts on the external surface of the chimney wall which allow the chimney to accommodate a DIC hearing aid with a larger range of diameter.

FIG. 10A is a perspective view; FIG. 10B is a side view.

DETAILED DESCRIPTION OF THE INVENTION

Embodiments of the invention provide systems, devices, and methods for a user or wearer of a hearing aid, particularly a deep-in-the-canal (DIC) hearing aid, to insert the hearing aid into his or her own ear. DIC hearing aids currently have a residence time of three to four months, which, with improvements in battery life, is likely to be lengthened in the future. Thus, insertion of a DIC hearing aid is not a frequent occurrence, but the option to do so without the assistance a healthcare provider is very advantageous for a user in a practical sense. Embodiments of the invention may also be used by a second person, such as a health care provider, a trained health care assistant, or a lay person of normal physical ability with only minimal training and practice, to insert the hearing aid into the ear of a user.

Embodiments of the invention generally allow the hearing device to be inserted without direct visualization of the ear or the tool by the user when self-inserting the hearing aid. The independence of a reliance on visualizing the process also is a benefit to a second person inserting the hearing aid into the ear of a user, simply because it allows a shift toward reliance on tactile direction of the insertion process. More generally, the device allows insertion without reliance on specialty instruments used by physicians and audiologists that are required by currently available methods of insertion. Further, the inventive DIC hearing aid insertion device is easily handled, allowing a precise insertion of a small device into a small orifice, without the need for a lot of practice or a high level of dexterity.

Figure 11:
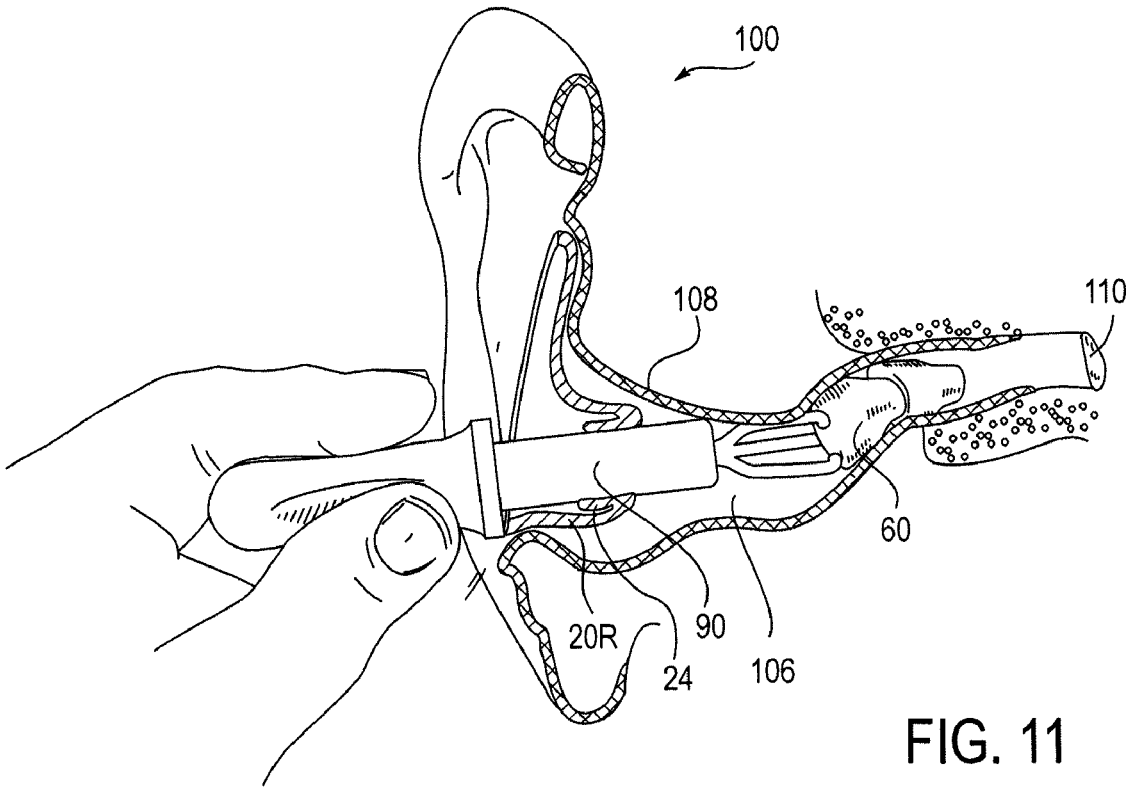
FIG. 11 shows an embodiment of a support base for a DIC hearing aid removal device positioned in an ear; an embodiment of a DIC hearing aid has been advanced into the ear canal and has engaged the hearing aid residing in the distal end of the canal.
Figure 12:
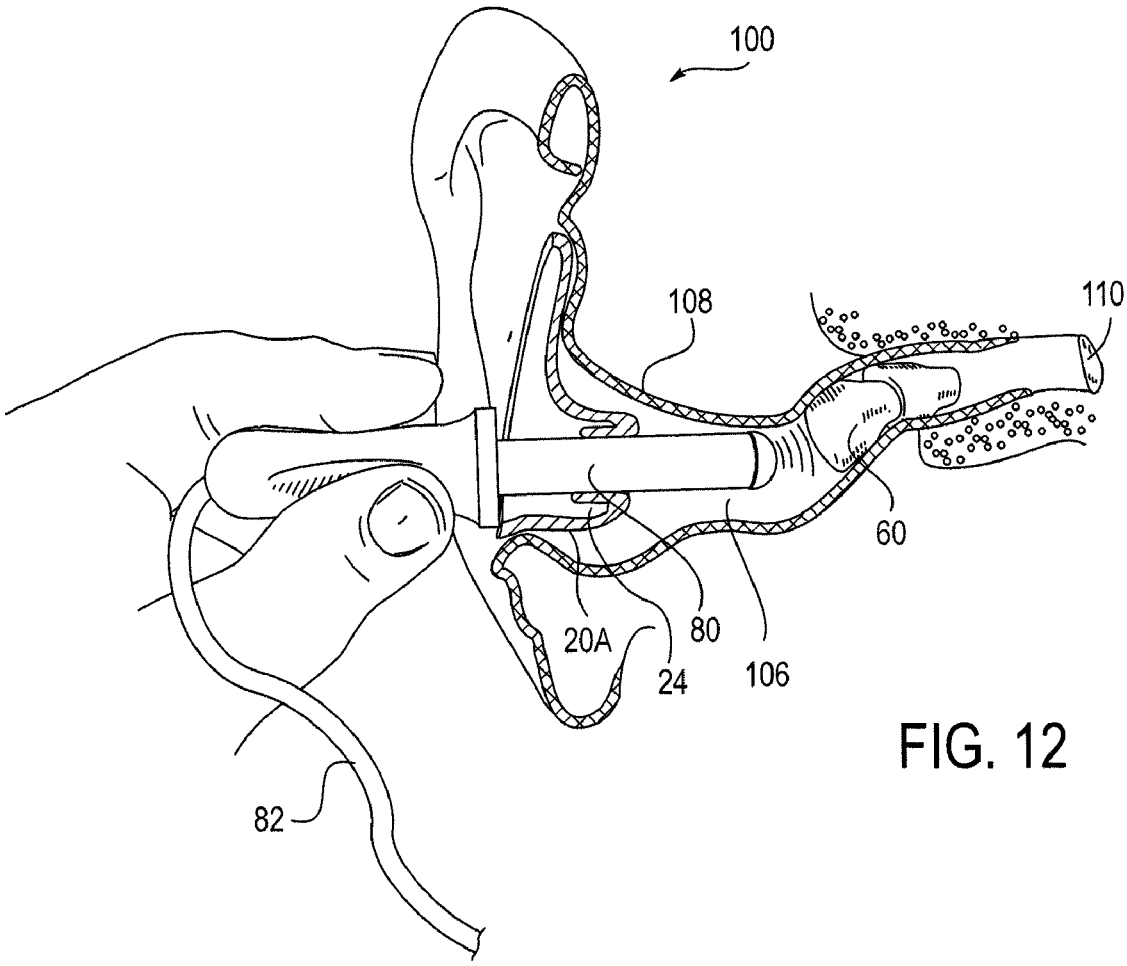
FIG. 12 shows an embodiment of a support base for a DIC hearing aid electromagnetic activation device positioned in an ear; a portion of an embodiment of a DIC hearing aid electromagnetic activation has been advanced into the ear canal and is in position to activate the DIC hearing aid.

Various embodiments and features of an inventive deep-in-the-canal (DIC) hearing aid insertion device are depicted in FIGS. 1-10. FIGS. 11 and 12 depict alternative embodiments of the invention that are directed, respectively, toward facilitating the use of a DIC hearing aid removal device and a facilitating the use of a DIC electromagnetic activation device. The invention and various embodiments will be described first from a general perspective, and then further below, described in greater detail in the context of each figure.

Some embodiments of a DIC hearing aid insertion device 10 may take the form of a capsule that includes a base portion 20 and a cover portion 40 that are either integrated in some manner or joined together so as to enclose an internal space or central cavity. In terms appropriate to the manner in which embodiments of the insertion device are used, the cover portion may be considered proximal, as it is the portion which the user manipulates when inserting a hearing aid, and the base portion may be considered distal, as an apical feature or chimney 22 of that portion is directed into the ear canal during usage. Analogously, a deep-in-the-ear-canal hearing aid that can be included within the insertion device (or placed therein) can be understood to have a proximal end that faces the external opening of the ear canal when the device is placed within an ear canal, and a distal end that faces the tympanic membrane at the terminus of the canal. When the DIC device or hearing aid is disposed within the insertion device, the proximal end of the hearing aid faces into the interior of the insertion device and the distal end is within the opening of a chimney facing outward, thus the proximal and distal aspects of the insertion device and the DIC hearing aid, respectively, are in accordance.

Embodiments of the base portion and cover portion of the device may be formed from a resilient and compliant material such as rubber or plastic such that the device as a whole is easily compressed with finger pressure, allowing the base and cover portion to come closer together, reducing the volume of the internal cavity. Materials comprising at least the external surfaces of the insertion device are typically non-allergenic, medical grade, and biocompatible. In some embodiments, the base and cover portions are not sealed, or the capsule may include vents, such that air can escape to facilitate the compression of the distal and proximal portions of the device together.

An external aspect of the base or platform portion of some embodiments of the insertion device is configured to fit into the conchal cavity of the ear; it may be broadly convex or conical in form; it typically includes a distally-projecting apical feature (which may be referred to as a chimney or barrel) having a channel within which a DIC hearing aid can be seated. The channel of the chimney has a distal-facing opening within which the distal end of the DIC hearing aid is disposed.

An external aspect of some embodiments of the cover portion of the device may also broadly convex or conical in form, and at its apex is an actuator, for example a button feature, that is externally adjacent to a piston 44 whose base connected to or disposed within the inner surface of the cover portion. Inasmuch as a function of the cover portion is to support a piston, the cover may also be generally referred to as a piston support structure. The piston projects distally into the central cavity of the device; its central longitudinal axis is collinearily aligned with the channel of the base portion, and thus collinearly aligned with a DIC hearing device if such a device is present in the channel. In some embodiments, a walled portion of the channel may extend proximally into the internal space of the device, forming a receptacle which guides the piston into the channel.

Some embodiments of the piston's structural support may be a simple outwardly convex cover that includes or supports an actuator feature, such as a button 42, which when actuated or pressed, moves the piston against a proximal surface of the DIC hearing aid positioned in the channel of the chimney within the base portion of the insertion device. Other embodiments of the piston's support structure may be envisioned that are larger for example, and may provide ergonomic advantages in terms of ease in handling. Further the insertion device may include ergonomically placed finger-engaging elements, such as tabs or finger pads (FIGS. 10A and 10B), that help a user hold the device securely and manipulate it with good control. In a typical embodiment of a method of inserting, for example, a user holds the insertion device in one hand, presses the piston with the index finger, and stabilizes the device on either side with the thumb and a middle finger.

Some embodiments of the insertion device may include a piston drive chamber such that when compressed it activates the piston to drive the DIC hearing device into the ear. The drive chamber can be pneumatic (air-driven) or hydraulic (driven by a liquid, for example, water or oil) and configured to drive the piston into the ear canal. These chambers of air, water, or oil can be mechanically compressed by a spring, or they may be activated by an electromagnetic or electrical switching mechanism in order to drive the piston into the ear canal. Such piston driving systems thus would not rely on finger pressure for inserting the DIC hearing aid, as does a mechanical system, as represented by a finger pressing a resilient insertion device cover or a button feature on a piston support structure.

Although embodiments of the major portions of embodiments of an insertion device have been described as comprising a compliant and resilient material, some features of the device may be formed from rigid plastic materials or metal, cast or machined. For example, some embodiments may include pistons or channel elements formed from metal, which may provide advantage to operation of the insertion device by virtue of their non-compliant quality and/or their more precise adherence to specified dimensions and tolerances.

Some embodiments of the piston support structure 40 (a cover portion of an insertion device, for example) may include a stabilizing or locking feature that prevents an unintentional ejection of the DIC hearing aid from the channel within the device. These features may require a particular deliberate unlocking action that it unlikely to occur unintentionally (such as a twisting action) to allow ejection of the hearing aid to proceed. In other embodiments, a piston movement resister element, such as a spring, may be included, which may obviate the need for a lock. A resister does not prevent movement of the piston, but rather increases the threshold of force required to move the piston to a level that it is unlikely to occur unintentionally.

The insertion device may also include a crescent-shaped appendage 55 that separates out from the main body, which is formed by the combined base and cover portions. This crescent-shaped feature is adapted to fit into the conchal fold of the ear, and thereby facilitate an appropriate seating of the insertion device into the ear of a wearer preliminary to the insertion of a DCIC device into the ear canal. As a whole, the basal aspect of the cover and base portions (as well as the basal profile of the conchal fitting appendage aspects), respectively, may be substantially complementary to each other so they can align against each other congruently.

In an embodiment of the manufacturing process the base portion and cover portion are molded as separate pieces and joined together in the assembly process. In other embodiments, the base portion and cover (or piston-supporting portion) can be molded as substantially separate pieces that are connected by a central linking portion that becomes a foldable joint (see FIG. 1B), which is then folded as the base and cover portions are assembled into final form.

In some embodiments of the manufacturing process, the insertion device is packaged with the DIC hearing aid preloaded into the capsule; in other embodiments, the DIC hearing device is not packaged within the capsule, but is loaded into the capsule by a user or by a health care provider. In embodiments where the manufacturing process preloads the DIC hearing device into the capsule, the base and cover portions of the device may be sealed together. In other embodiments, the base and cover portions may be unsealed or partially sealed; in such embodiments, the base and cover portions may include mutually locking features that allow the device to be opened and then securely closed. Finally, embodiments of the insertion device and some of its component portions include mirror image forms for the right ear and the left ear, respectively. As is customary with hearing aids, the right and left forms of the insertion device can be marked to indicate their right or left orientation.

A DIC hearing aid 60 is typically loaded or seated into the base portion 20 of the device; the distal face of the DIC hearing aid is secured within the channel 24 of the chimney, typically flush against the opening 23 surface of the channel and facing distally outward from within the opening. In alternative embodiments of the method of the invention, loading of a DIC hearing aid into the insertion device may be performed as part of the manufacturing process, or loading may be performed by an end user. In a typical approach, the hearing aid is seated into the channel from the proximal opening of the channel. Some embodiments of the channel may include markings or visible raised features that identify the appropriate point for the proximal end of the hearing to be located. Thus, as a user or manufacturing technician is loading the hearing into the channel, the appropriate position can be known to have been reached when that mark or raised feature becomes visible. Other than the distal face of the hearing aid facing outward from within the opening of the apical feature of the base, the body of the hearing is enclosed within the channel of the apical feature or within the central cavity of the insertion device. The internal channel of the chimney of the base is of a dimension that securely clasps a least a portion of the length of the DIC hearing device.

DIC hearing aids vary in their dimensions (see below); however, in one embodiment of the insertion device, the outer dimensions (e.g., the cover, the base, the chimney) of the insertion device are of a common one-size-fitting all sizes (or most sizes) of hearing aid. Dimensions of internal features (e.g., the piston, the channel) of the insertion device, however, may vary to accommodate DIC hearing aids of different sizes. DIC devices themselves can vary in dimensions, for example in the embodiments described in U.S. Pat. No. 7,310,426 of Shennib, the diameters of the devices are determined by a sealing retainer portion that is formed from a soft, compressible, and conforming material that surrounds the inner hard portions (e.g., microphone, battery, connector portion, receiver). The cross-sectional dimensions of the retaining portion of a DIC hearing aid include a short diameter portion that ranges between 4.5 mm and 9 mm, and a large diameter portion that ranges between 7.25 mm and 15 mm. Although the diameter of the chimney's channel and of the distal opening of the channel may be one particular size, the channel and opening can accommodate a range of DIC hearing device diameters by virtue of the inserter base composition being compliant, and by the inclusion of longitudinal relaxation cuts 31 within the channel.

Although the figures depict DIC hearing devices and the channel of the chimney as being generally circular in cross section, typical embodiments of DIC devices are ovoid in cross-sectional profile to better fit the typically ovoid profile of an ear canal, and accordingly, so may the embodiments of the channel of the insertion device be ovoid. The ovoid aspect of ear canal is oriented with the long diameter having a cephalad-caudal orientation. Accordingly, the orientation of the long diameter of an ovoid channel is also cephalad-caudal, and orientation that is made in relation to the position of the crescent-shaped appendage which orients the insertion device into the ear as a whole.

The central longitudinal axis of the piston and the central longitudinal axis of the DIC hearing aid are collinearly aligned within the central cavity of the insertion device (when the hearing aid is placed within the insertion device, and when the cover and base of the device are in their final closed configuration). In its native, uncompressed configuration, the distal face of the piston and the proximal face of the DIC hearing aid are typically separated from contact by a gap. However, as distally-directed pressure is applied to the button on the cover portion, and the device as whole begins to assume a compressed configuration, the distal face of the piston and the proximal face of the DIC hearing aid come into contact. With the application of further pressure, the piston drives the hearing aid out of the distal opening of the apical chimney of the base. In the context of a method of inserting a DIC hearing device wherein the apex of the base has been positioned in the ear canal, as the piston drives the DIC device through the channel apex and through the distal opening, the DIC hearing aid is ejected from the inserter and is appropriately situated within the ear canal. As the piston is advanced to its most forward or distal position, the DIC hearing aid is brought to its intended residence site, within about 4 mm of the tympanic membrane.

Dimensions and relative positions of the piston, various elements that support the piston, the channel, and stop features of the channel may vary to accommodate DIC hearing aids of different sizes. For example, DIC hearing aids currently manufactured InSound Inc (Newark, Calif.) include the Lyric 1™ and the Silver Bullet™, the Lyric being about 2.5 mm longer than the Silver Bullet™. Accordingly, embodiments of an insertion device may be sized to fit such particular dimensions. Embodiments of the insertion device, to accommodate the two DIC hearing aids per this example, could vary by having a different piston length and/or a different length insertion channel to control the depth of insertion into the ear canal such that, despite different hearing aid lengths, the distal end of the hearing aid is advanced to a point within 4 mm of the tympanic membrane. Similarly stop features arranged on either the piston and/or the channel may control the depth of insertion in such a manner.

Examples of pertinent linear dimensions of the outer ear canal, the chimney of an insertion device, and a DIC hearing aid will now be provided to further an understanding of considerations related to the piston of the device and, in particular, to the distance beyond the opening of the channel of the device to which the piston should be extended during insertion of a hearing aid. An ear canal is typically about 25 mm long from its opening (at the pinnal fold) to the tympanic membrane. The distal end of the chimney of an insertion device, when placed in the ear canal, is typically at point between about 4 mm to about 5 mm past the ear canal opening. This distance also corresponds to the height of the chimney from the base portion of the insertion device. In some embodiments, the height of the chimney can vary within a wider range, as for example between about 2.5 mm and about 10 mm. A typical DIC hearing aid has a length of about 13-16 mm. Per embodiments of the method of this invention, it is desirable to position the distal surface of the hearing aid at a distance within about 4 mm from the tympanic membrane. In some embodiments, this distance between the device and the tympanic membrane will be between about 1 mm and about 4 mm.

Thus, depending on variations in all the preceding linear dimensions, it can be understood, for example, that the distal end of the piston needs be able to advance to a distance of about 1 mm to about 4 mm beyond the opening of the insertion device channel, and no further. Various aspects of the device may be configured to control the maximal depth of the insertion. In one aspect, the entire length of the piston itself may be a factor. In another more particular aspect, a limiting factor may be the length of the piston that is able to project distally beyond the opening of the channel. Various stop features within the device, such as within the piston support structure or cover, within the channel of the chimney, or on the piston, or any combination thereof, may be utilized to limit the distance the piston is able to project forward from the opening of the device, and into the ear canal. For example, one particular feature that can serve as a stop feature is a receptacle portion 25 of the internal channel which projects into the capsular space defined by the device base and cover. In various embodiments, the receptacle wall meets a portion of the piston support structure and thereby prevents further movement of the piston into the channel; in this example, the height of the receptacle portion can control the limit of distal movement of the piston into the channel, and hence, into the ear canal.

In some embodiments, a protective membrane or enclosure is wrapped over the distal surface of the DIC hearing device to protect the integrity and cleanliness of that surface prior to the time of insertion of the device into an ear canal. The membrane is breakable upon application of the level of pressure that is applied to the piston that drives the DIC hearing device out of the insertion device (i.e., out of the chimney's channel) and into the ear canal. Upon breakage, the base portion of the broken membrane remains attached to the chimney of the base of the inserter. In some embodiments, the membrane may include weak points or tear lines that provide a predictable and consistent break pattern.

In another aspect of the invention, the insertion device is also a package for a DIC hearing aid, as may be delivered to a health care provider or sold over the counter. In this embodiment the insertion device includes a DIC hearing device loaded within it. A DIC hearing aid packaged in this manner may be further protected by another layer of conventional packaging. This packaged form of a product provides several benefits to the user and for the overall distribution of the product into the market. In this packaged form, the DIC hearing aid is fully protected and tamper proof from the time it leaves the manufacturing facility until the time it is already placed in the ear canal. The insertion device as a package is much easier to handle than a naked DIC device, and in fact a user does not touch or handle the DIC hearing aid at all, thus keeping it clean. An assisting second person, such as healthcare professional or any capable assistant, also takes advantage of these benefits when inserting a DIC hearing aid device into the ear canal of a user. DIC hearing devices are manufactured in various different sizes and forms. In embodiments of the invention that include a preloaded DIC device as a package, the package and/or the outer surface of the insertion device may be identified with marks or labeling with regard to the specific features of the DIC device included within.

Some embodiments of the invention may also be applied to the removal of a DIC hearing device. Thus, other embodiments of the invention may include a device in the form of a support base or platform for a DIC hearing aid removal device, a system that includes a DIC hearing aid removal device, and methods of using the system and device. An exemplary embodiment of this form of the invention is similar to that of a DIC hearing aid insertion device, however the platform for a removal device does not include a piston and a piston support structure as included in embodiments of the insertion device. The DIC hearing aid removal device support includes a base platform, the distal surface of which fits into the conchal cavity of an ear, and a chimney that projects distally from the distal surface of the base; the chimney includes a channel (as does the base portion of embodiments of the insertion device). The channel of this embodiment of the removal device platform is sized to accommodate a DIC hearing aid removal device, allowing it to enter the ear canal. An example of a DIC hearing aid removal device is described in U.S. Pat. No. 7,388,961 of Shennib, which issued on Jun. 17, 2008. Another embodiment of the invention is thus a kit that includes an insertion device with a hearing aid included therein in and a support platform for a removal device, and an optional DIC hearing aid removal device. Typical embodiments of this type of kit include labeling on any packaging layer, and written and pictorial instructions on methods of use.

Aspects and exemplary embodiments of the invention, as generally described above, are now described further and in greater detail in the context of FIGS. 1-12, as follows below.

Figure 1A:
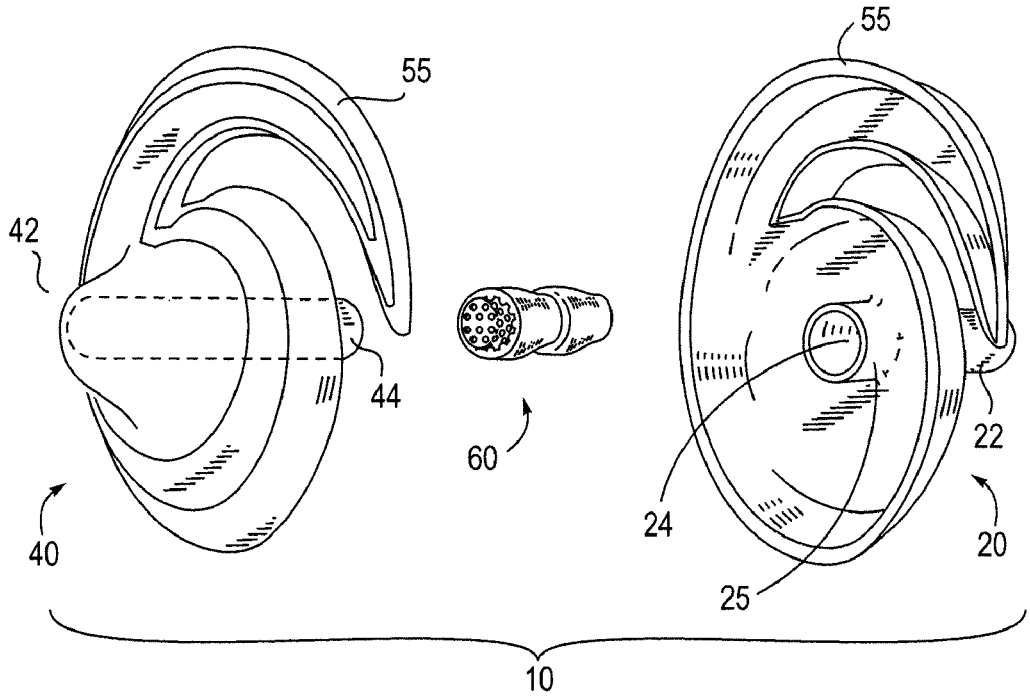
FIG. 1A is an exploded distal-looking perspective view of a deep-in-the-canal (DIC) hearing aid insertion device, with a cover portion, piston, and base portion.

FIG. 1A is an exploded distal-looking perspective view of a deep-in-the-canal (DIC) hearing aid insertion device 10, with a cover portion 40, piston, and base portion 20. An embodiment of a dome-shaped support structure or cover 40 for the piston 44 is seen at the right. In the center is a DIC hearing aid 60. And on the right is an insertion device base 20. The piston 44 is held by its proximal end within an actuator 42 that externally manifests, in this particular embodiment as a button that can be pressed by a user. The support structure for the piston is moveable in such a way that moves the piston distally, where, in an assembled version of the device, the piston 44 encounters the proximal end of the hearing aid 60, which is seated within the channel 24 of the base, the channel itself being disposed within a chimney 22. A piston receptacle portion 25 is an aspect of the channel that continues into the interior of the device from the distally-situated chimney 22. In typical embodiments, when the insertion device is assembled and closed, a distal portion of the hearing aid 60 is partially disposed within the receptacle.

Figure 1B:
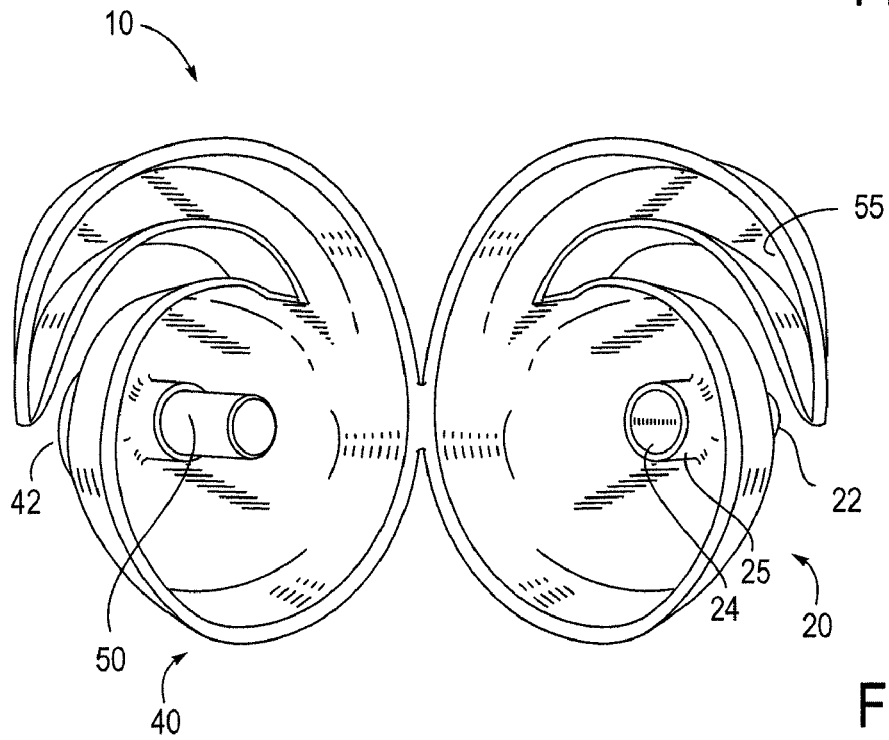
FIG. 1B is frontal view of a deep-in-the-canal (DIC) hearing aid insertion device with the cover portion and base portion connected on a side as they emerge from a mold, the two portions opened in butterfly fashion.

FIG. 1B is frontal view of a deep-in-the-canal (DIC) hearing aid insertion device 10 with the cover portion 40 and base portion 20 connected together on a side as they emerge from a mold, the two portions opened in butterfly fashion, the common portion serving as a foldable joint. In some embodiments of the method of manufacture, the piston 44 is molded and integral with the cover portion; in other embodiments of the method, the piston is separately formed and assembled into the cover. The latter option allows for the piston to be of a composition distinct from that of the cover and base portions.

Figure 2:
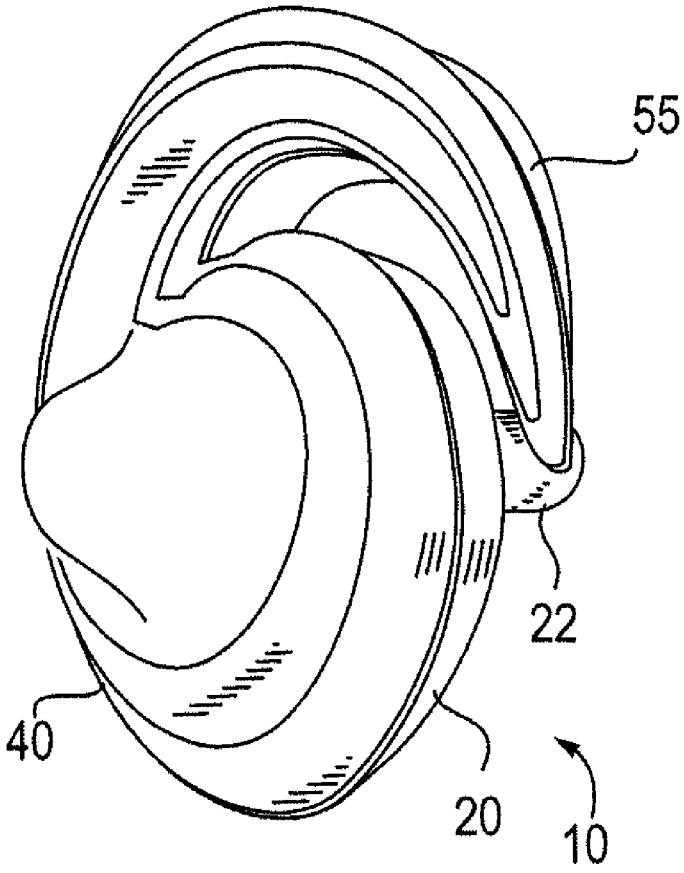
FIG. 2 is a distal-looking exterior perspective view of an assembled a deep-in-the-canal (DIC) hearing aid insertion device FIG. 3 provides an exposed side view of an insertion device, with a piston in a neutral position, its distal surface aligned against the proximal surface of a DIC device in the ejection channel of the chimney of the insertion device.

FIG. 2 is a distal-looking perspective view of the exterior of an assembled deep-in-the-canal (DIC) hearing aid insertion device 10. The piston support portion or cover 40 is shown attached to the base portion 20. FIGS. 1 and 2 both show an optional crescent shaped feature 55 which is configured to fit into the conchal fold of an ear and help position or stabilize the insertion device appropriately.

Figure 3:
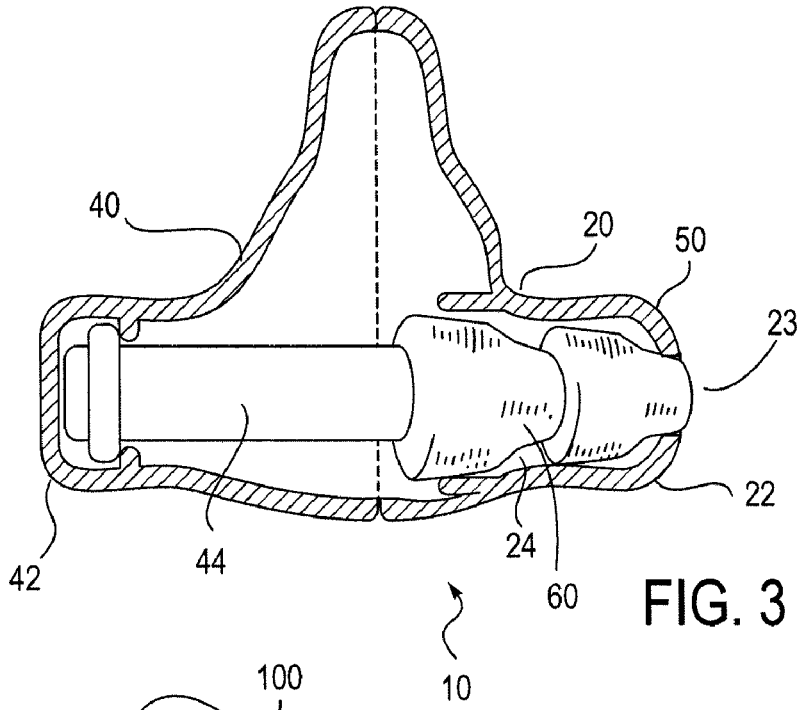
Figure 4:
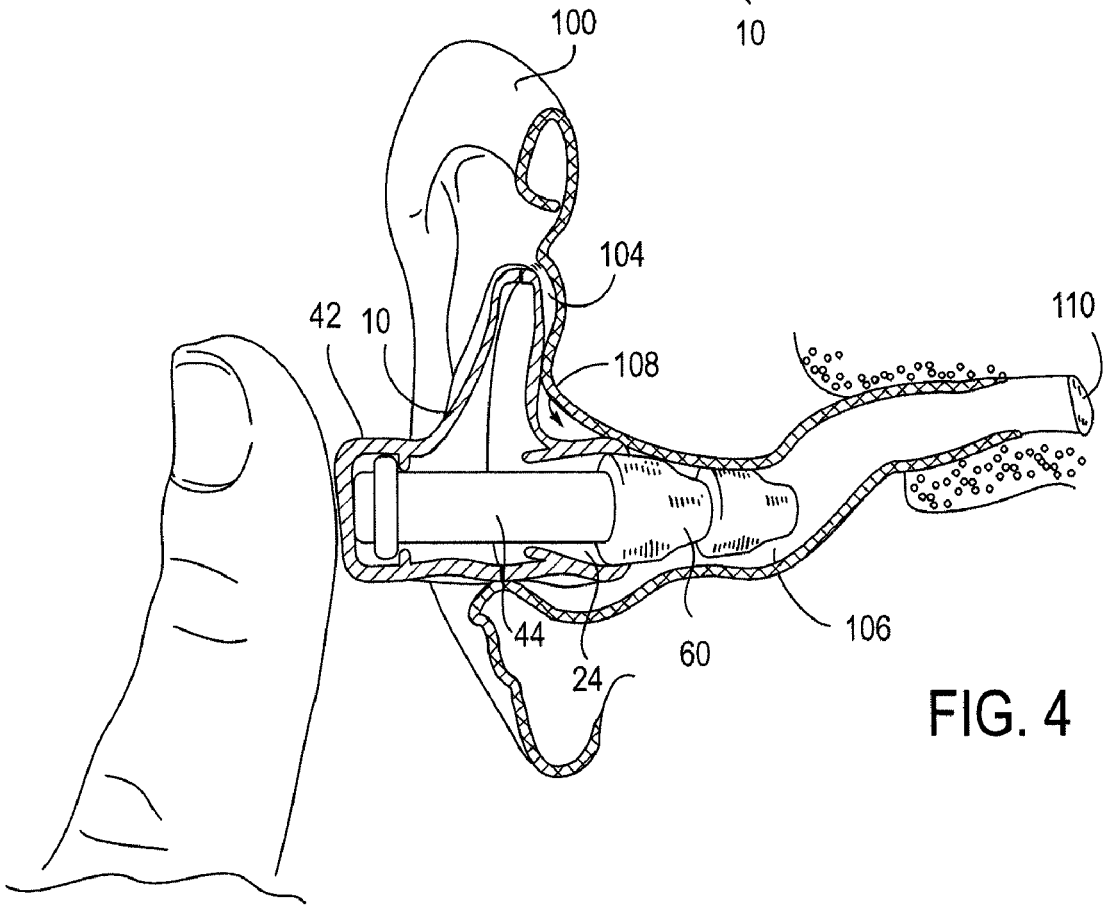
FIG. 4 shows an insertion device placed into an ear, with the chimney inserted into the outer aspect of the ear canal, the piston having been partially depressed such that the DIC device has been ejected from the channel.
Figure 5:
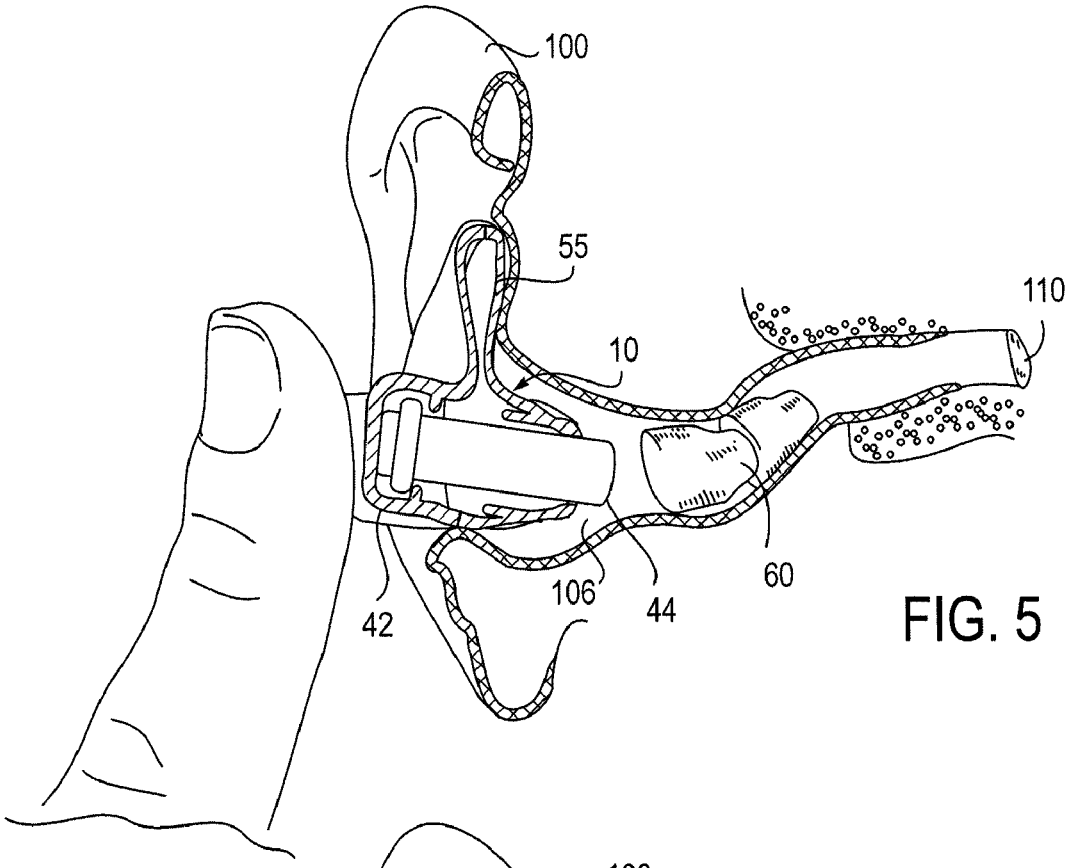
FIG. 5 shows a point in the insertion method following the moment of FIG. 4, where the piston has been further depressed such that the DIC device has been advanced further into the ear canal.
Figure 6:
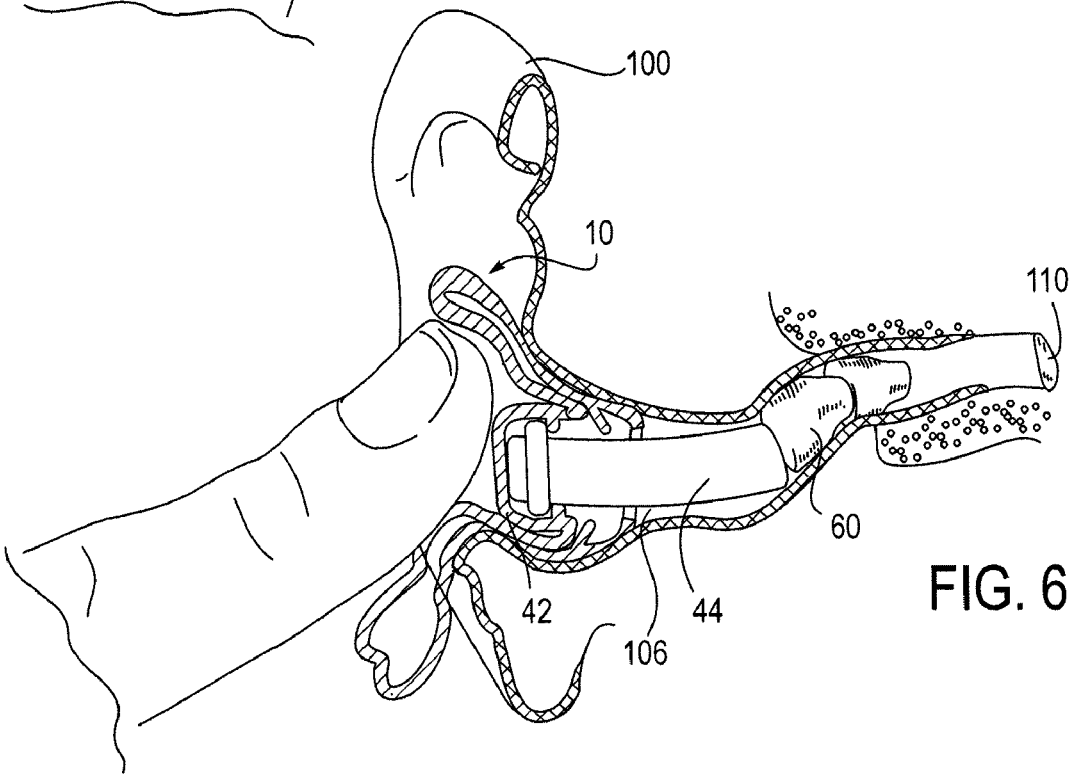
FIG. 6 shows a point in the insertion method following the moment of FIG. 5, where the piston has been maximally depressed such that the DIC device has been advanced to its target position into the ear canal, 2-4 mm from the tympanic membrane.

FIGS. 3-6 show cross sectional side views of an embodiment of an insertion device 10; FIGS. 4-6 show the device in a sequence wherein a DIC hearing aid is being inserted into an ear canal. FIG. 3 provides an exposed side view of an insertion device 10, with a piston 44 in a neutral position, its distal surface aligned against the proximal surface of a DIC hearing device in the ejection channel of the chimney of the insertion device.

Figure 7:
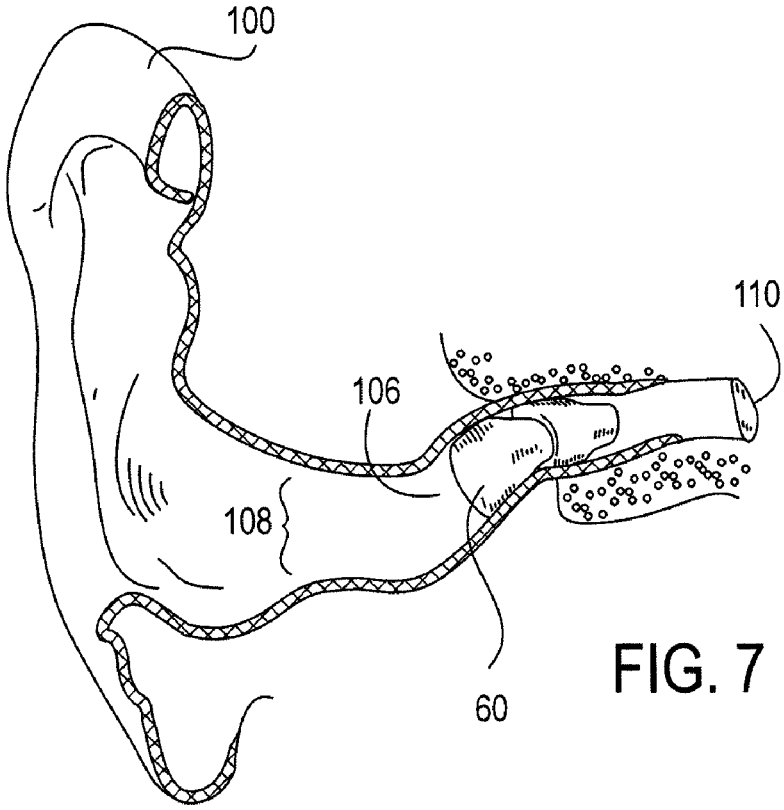
FIG. 7 shows DIC device positioned at its target position into the ear canal, 2-4 mm from the tympanic membrane, and insertion device having been withdrawn.

FIG. 4 shows an insertion device 10 placed into the conchal cavity 104 of an ear 100, with the chimney 22 inserted into the outer aspect of the ear canal 106, the piston 44 having been partially depressed such that the DIC hearing aid 60 has been ejected from the channel. FIG. 5 shows a point in the insertion method following the moment captured by FIG. 4; now the piston 44 has been further depressed such that the DIC hearing aid 60 has been advanced further into the ear canal 106. FIG. 6 shows a point in the insertion method following the moment of FIG. 5, where the piston has been maximally depressed such that the DIC hearing aid 60 has been advanced to its target position into the ear canal, 2-4 mm from the tympanic membrane. FIG. 7 shows a DIC hearing aid 60 positioned at its target position into the ear canal 106, well beyond the ear canal opening 108, and at a distance 2-4 mm from the tympanic membrane 110, the insertion device having been withdrawn.

It may be seen that FIG. 6 also depicts the piston 44 flexing as it is being pushed into the ear canal. In some embodiments the piston is rigid, in other embodiments the piston comprises a compliant composition and is flexible. Flexibility can be advantageous when the piston is negotiating an ear canal which typically has a bend at about the midpoint, where a transition between a cartilaginous portion and a bony portion occurs. Some embodiments of the piston have a distal surface that is adapted to be complementary to the proximal surface of a particular DIC hearing aid. Some embodiments of the piston further have a beveled circumferential edge on the distal face, albeit with central region in the distal surface that is either flat or (as just noted) complementary to the proximal surface of the hearing aid. The beveled edge can provide an advantage that supports a smooth advancement of the piston into the ear canal, thus preventing damage to the ear canal. As the piston advances it glances against a surface of the canal in the event of encountering the surface, rather than scraping or digging in.

Figure 8A:
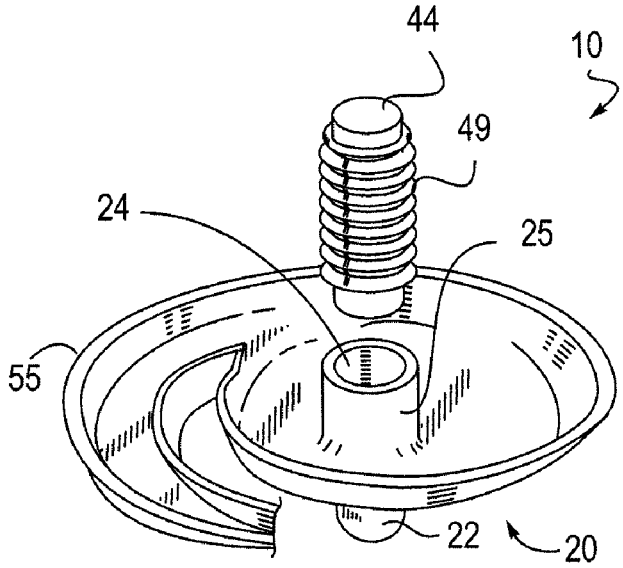
FIG. 8A shows a side perspective view of the base portion of an embodiment of the insertion device and a piston collinearly-aligned with the channel within the chimney of the base, and a movement resistor feature associated with the piston.

FIG. 8A shows a side view of the base portion of an embodiment of the insertion device 10 and a piston collinearly-aligned with the channel within the chimney of the base. This figure emphasizes basic features of the insertion device, which include a base 20 with a chimney 22 and an internal channel 24 that connects to the distal exterior through an opening, and a piston 44 collinearly aligned with the channel. Elements of a support structure that supports the piston are not shown, other than an exemplary guide sleeve 49; this structure can be seen to comprise a spring or an accordion-like folded feature that also serves as a movement resister as described further below. The absence of a more complete structural support for the piston in this depiction emphasizes that such a support may have a wide variety for forms, the cover embodiment 40, as shown in FIGS. 1-6, being but one example. Other embodiments may be envisioned by those skilled in the art; variations are generally directed toward providing ease in handling of the device and implementing the insertion of a DIC hearing aid.

Figure 10A:
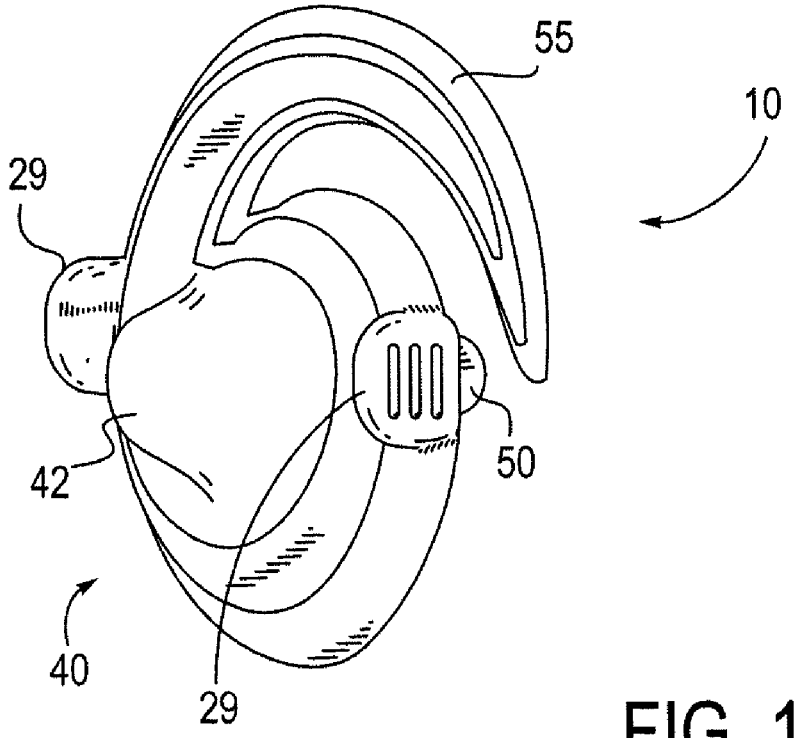
FIGS. 10A and 10B show an embodiment of an insertion device that includes finger dents or tab portions that allow easy handling of the device.
Figure 10B:
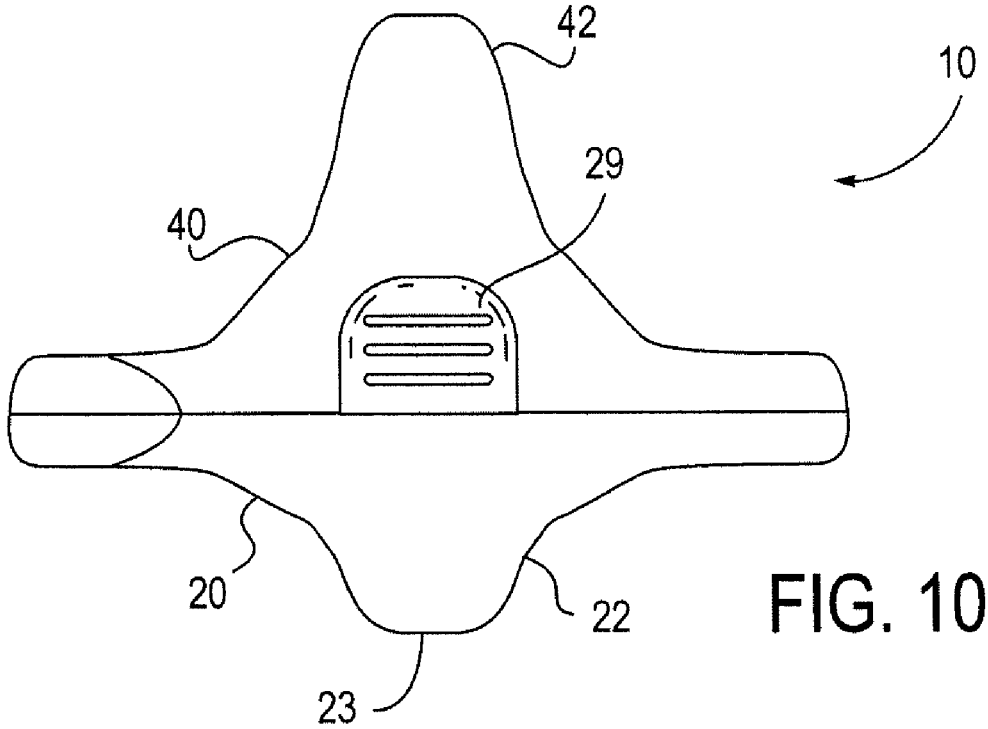

One example of feature that facilitates handling and use of the insertion device is depicted in FIGS. 10A and 10B (perspective view and side view, respectively) which show an embodiment of an insertion device 10 that includes finger dents or tab portions 29 that allow easy handling of the device. These tab portions are shown positioned opposite each other on the right and left sides of a device (as it is oriented with the crescent-shaped feature at the top) as may be typical, but such features may be arranged in any configuration that provides a handling advantage. These tabs are typically attached or integrated into the cover portion 40 of device 10, but in some embodiments may be attached to the base portion 20. The exemplary tabs are positioned to facilitate handling of the device, as, for example, a user would operate the piston of the insertion device with an index finger, and grasp the device on either side with a thumb and a middle finger, respectively.

Referring again to FIG. 8, the guide sleeve 49 includes a folded surface, accordion-like or spring-like, that allows compression, but also provides a resistance to collapse. It is advantageous for movement of the piston to have a resistance that prevents an inadvertent distal movement. The appropriate amount of resistance provided by a movement resister mechanism 49 is one that prevents movement of piston with incidental handling, but which is also easily overcome by force of a level provided by the finger of a user. Some embodiments of the piston support structure also may, for example, include a locking mechanism, which, in its default position, or the position in which the insertion element is provided to a user, is locked. Such a lock is typically unlocked easily, as in the form of a twisting mechanism, which can be twisted with one or two fingers by a user immediately prior to inserting a DIC hearing device. In other embodiments, the piston movement resistive element may be a spring. In some embodiments, the resistive force may be provided by the structure as a whole, as for example, the cap-shaped cover 40 as in the embodiments depicted in FIGS. 1-6 functions as a dome-shaped leaf spring that resists distal movement of the piston.

Figure 8B:
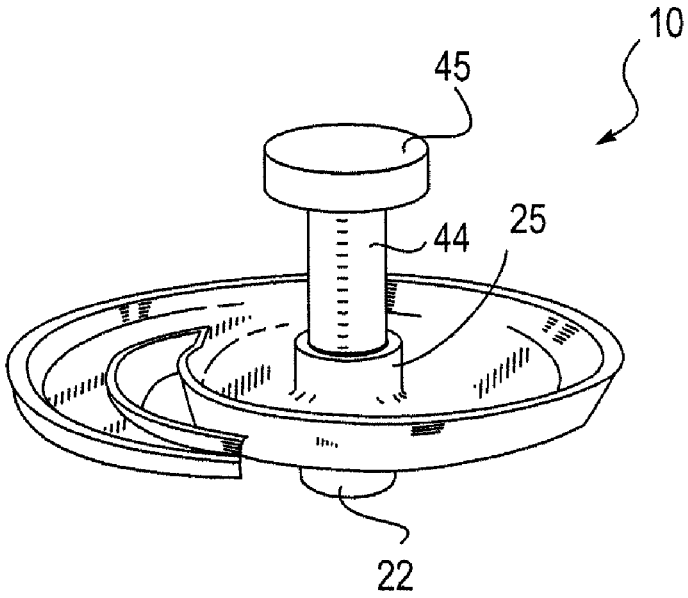
FIGS. 8B and 8C show side perspective views of a base portion of an embodiment of the insertion device and a portion of a cover portion with a surface that abuts against a receptacle portion of the base.
Figure 8C:
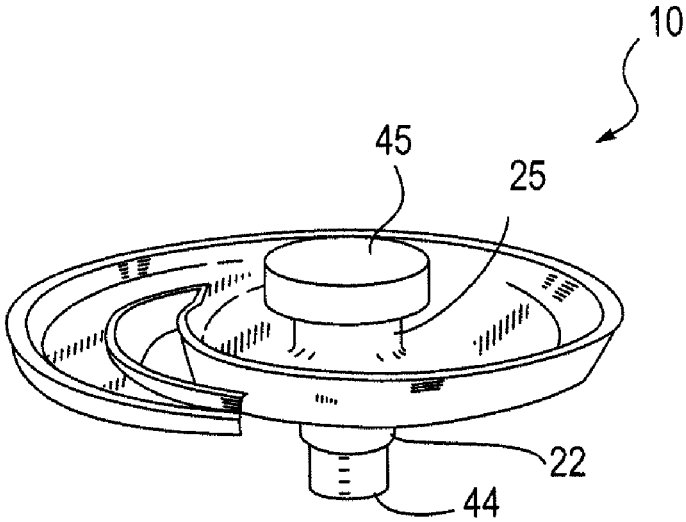

It is advantageous in the operation of the insertion device, that the extent of movement of the piston, more particularly, the distance to which the piston pushes a DIC hearing aid into the ear canal be well-controlled and limited to particular specifications. Thus, some embodiments of the device include features that cooperate to provide a limit to the advancement of the piston into the channel, such features being associated with any one or more of the piston support structure, the piston, or the channel. FIGS. 8B and 8C show insertion device features that cooperate to form a movement stop. A raised receptacle wall 25 contiguous with the channel 24 extends proximally above the base 20 and an abutting surface 45 on the piston support structure adjacent to a proximal portion of the piston 44 are aligned such that the abutting surface and receptacle wall meet when the piston support structure is advanced toward the base. FIG. 8B shows the insertion device in an open configuration, prior to the piston being pushed. FIG. 8C shows the device after the piston 44 has been pressed distally, and can be seen projecting from below the base. In another example of features that cooperate to form a movement stop, an external aspect of the piston and an internal aspect of the channel are mutually configured such that the distance of distal movement of the piston into the channel is limited. For example, the piston may include a raised annular portion while the channel includes an abutting surface with an internal diameter that is smaller than an external diameter of the raised annular portion.

Figure 9A:
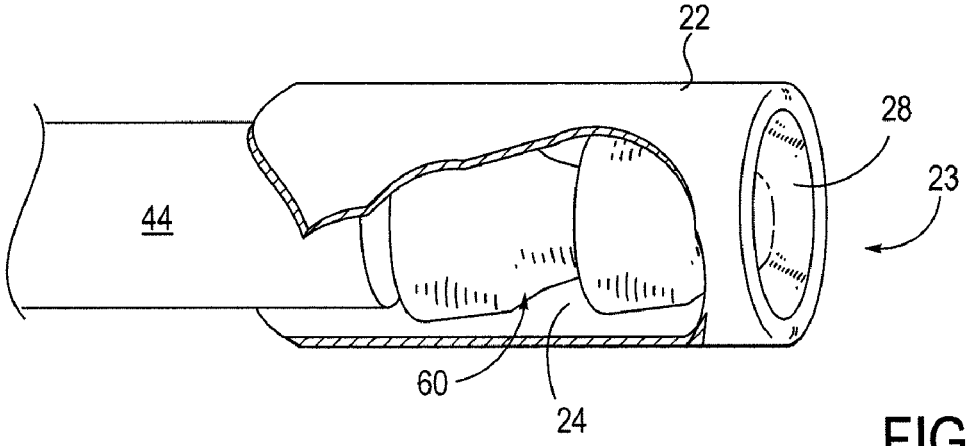
FIGS. 9A-9C provide views of distal end of the chimney portion of a DIC hearing aid insertion device.
Figure 9B:
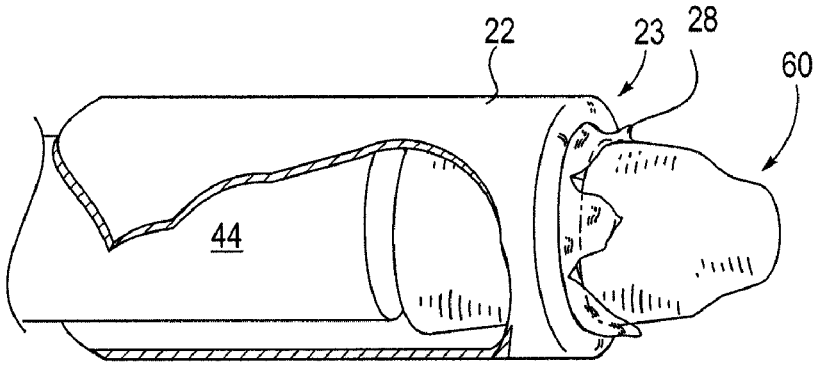
Figure 9C:
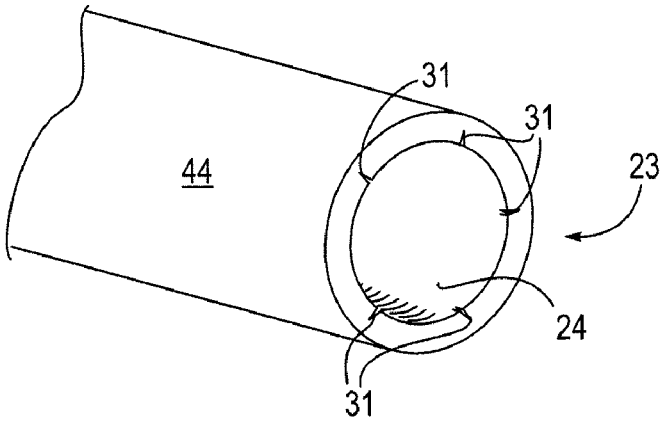

FIGS. 9A-9C show views of the distal end of embodiments of a chimney portion of an insertion device, focusing on various features associated with the opening 23 of the channel. FIG. 9A shows a proximal-looking perspective view of an embodiment of a chimney 22 of a base portion 20 of an insertion device 10 with a membrane 28 covering the opening 23 of the chimney and the hearing aid 60 seated in the opening. FIG. 9B the chimney of FIG. 9A after the DIC hearing aid 10 has been pushed out of the chimney 22 by piston 44, and while emerging from the chimney, the hearing aid 10 has broken membrane 28, leaving remnant membrane attached to the chimney. FIG. 9C shows a perspective view of the distal end of the chimney showing the presence of relaxation cuts 31 on the external surface of the chimney wall that allow the chimney to expansively accommodate a DIC hearing aids with a larger range of diameter (membrane 28 is not shown in this view).

FIG. 11 shows an embodiment of a support base or platform 20R for a DIC hearing aid removal device 90 positioned in an ear. An embodiment of a removal device 90 has been advanced into the ear canal and has engaged the DIC hearing aid 60 residing in the distal end of the canal. The support for the removal device comprises a platform 20R that is very similar in form to embodiments of the base portion 20 of the insertion device (FIGS. 1-10); the platform may include a channel 24 within the chimney 22 that is slightly larger than the channel. The advantages provided by the use of a stable platform to facilitate the use of a hearing aid removal device are similar to those provided by the use of the insertion device described herein. Presently, with a conventional approach to insertion of DIC hearing aids, in the office of a physician or audiologist, there is little reason for a user to remove a DIC hearing aid as such removal is conventionally included in the office visit where a new hearing aid is inserted. With the ability to self-insert a DIC hearing aid, there is thus a complementary need for a user to easily remove a hearing aid. While the removal of a hearing aid by a removal tool such as that described in U.S. Pat. No. 7,388,961 is considered generally within the ability of a user without professional assistance, the platform 20R makes such removal much easier for the typical DIC hearing aid user.

DIC hearing aids may be activated by an electromagnetic activation device such as that described by Shennib in U.S. Pat. No. 7,016,511 (issued on Mar. 21, 2006). Such activation not only can switch the hearing aid on, but may further be used to establish operational parameters of the hearing aid according to a patient-specific prescription. It is envisioned that such prescribed programs can be made available through secure websites. Thus, a patient may access a website and deliver the program to the hearing aid by way of a USB connection, through the electromagnetic activation device, and switch on the hearing aid residing in his or her ear canal, and direct the operational parameters according to the prescription. An advantage of activating a DIC hearing aid while resident in the ear is that the hearing aid user can hear sounds from the hearing aid that verify that the activation has occurred.

Accordingly, another embodiment of the invention is shown in FIG. 12, where an embodiment of the inventive support base or platform 20A is being used to provide a well controlled access of the distal tip of an electromagnetic activation device 80 into the ear canal 106 of a hearing aid wearer, and into the proximity of the DIC hearing aid 60 residing therein. In this embodiment of the invention, the channel 24 within the chimney portion of platform 20A is of an appropriate diameter to allow easy accommodation of the electromagnetic activation device. The electromagnetic activation device 80 may have a cable 82, such as a USB cable, or a cable connection at its proximal end, the cable being connectable to a computer with internet access at its proximal end. The cable may be connected during the activation process, or the cable connection may be used to load the program into the electromagnetic activation device, which in turn transmits the program to the hearing aid during the activation process.

The advantages provided by use of the platform 20A are similar to those described above in the context of DIC hearing aid removal in that use of the platform stabilizes the process of hearing aid activation, and generally allows movement of all aspects of DIC hearing aid handling (insertion and removal) and set up available to the hearing aid user independently of a previously necessary visit to a healthcare provider, or having to rely on the help of a trained second person. Accordingly, a system for activation of a DIC hearing aid, per this embodiment of this invention, includes an electromagnetic activation device insertion platform, as described, and a programmed or programmable electromagnetic activation device.

Terms and Conventions

Unless defined otherwise, all technical terms used herein have the same meanings as commonly understood by one of ordinary skill in the art of hearing aid technologies. Specific methods, devices, and materials are described in this application, but any methods and materials similar or equivalent to those described herein can be used in the practice of the present invention. While embodiments of the invention have been described in some detail and by way of exemplary illustrations, such illustration is for purposes of clarity of understanding only, and is not intended to be limiting. Various terms have been used in the description to convey an understanding of the invention; it will be understood that the meaning of these various terms extends to common linguistic or grammatical variations or forms thereof. Terminology that is introduced at a later date that may be reasonably understood as a derivative of a contemporary term or designating of a hierarchal subset embraced by a contemporary term will be understood as having been described by the now contemporary terminology. Moreover, any one or more features of any embodiment of the invention can be combined with any one or more other features of any other embodiment of the invention, without departing from the scope of the invention. Still further, it should be understood that the invention is not limited to the embodiments that have been set forth for purposes of exemplification, but is to be defined only by a fair reading of claims that are appended to the patent application, including the full range of equivalency to which each element thereof is entitled.

I claim:

1. A device for insertion of a deep-in-the-canal (DIC) hearing aid into an ear canal comprising:

a base configured to fit into the conchal cavity of an ear;

a chimney projecting distally from the base, the chimney configured to fit into the ear canal and including a channel sized to accommodate a DIC hearing aid and a distal opening sized to permit passage of the DIC hearing aid; and a piston supported by a support structure such that a central longitudinal axis of the piston and a central longitudinal axis of the channel are collinearly aligned, the piston being distally moveable into the channel.

2. The device of claim 1 wherein the height of the chimney is about 2.5 mm to about 10 mm above the distal surface of the base.

3. The device of claim 1 wherein the height of the chimney is about 3 mm to about 7 mm above the distal surface of the base.

4. The device of claim 1 wherein the channel of the chimney comprises a proximal raised receptacle portion sized to accommodate the piston.

5. The device of claim 1 wherein the piston support structure comprises an actuator adapted to move the piston distally.

6. The device of claim 5 wherein the actuator comprises a button on a proximal surface of the support structure adjacent to a proximal base of the piston.

7. The device of claim 1 wherein the piston support structure comprises a cover, the cover and the base defining a cavity within the insertion device.

8. The device of claim 7 wherein the piston support structure and the base comprise a compliant and resilient material such that the piston support structure may be pressed toward the base by finger pressure.

9. The device of claim 1 comprising features that cooperate to provide a limit to the advancement of the piston into the channel, such features being associated with any one or more of the piston support structure, the piston, or the channel.

10. The device of claim 9 wherein the channel comprises a raised receptacle wall portion extending proximally above the base and wherein the piston support structure comprises an abutting surface adjacent to a proximal portion of the piston, the receptacle wall and piston support structure surface aligned such that the abutting surface and receptacle wall meet when the piston support structure is advanced toward the base.

11. The device of claim 9 wherein the piston comprises a raised annular portion and the channel comprises an abutting surface with an internal diameter that is smaller than an external diameter of the raised annular portion.

12. The device of claim 1 wherein the piston is flexible.

13. The device of claim 1 wherein the piston is rigid.

14. The device of claim 1 further comprising a piston movement resistor element.

15. The device of claim 1 further comprising finger engaging elements.

16. A method of packaging a deep-in-the-canal (DIC) hearing aid comprising the steps of:

seating the DIC hearing aid in an DIC hearing aid insertion device according to claim 1; and closing the base and the piston support structure of the insertion device together.

17. The method of claim 16 further comprising the step of attaching the base and the support structure of the insertion device together.

18. The method of claim 16 further comprising the step of applying a membrane across a distal opening of the channel.

19. The device of claim 1, further comprising:

a breakable membrane over distal opening.

20. A device for insertion of a deep-in-the-canal (DIC) hearing aid into an ear canal comprising:

a base configured to fit into the conchal cavity of an ear;

a chimney projecting distally from the base, the chimney configured to fit into the ear canal and including a channel, sized to accommodate a DIC hearing aid, with an internal surface that includes a material sufficiently compliant to compressibly secure a hearing aid within the channel and sufficiently low in frictional resistance to allow passage therethrough in response to finger pressure force; and a piston supported by a support structure such that a central longitudinal axis of the piston and a central longitudinal axis of the channel are collinearly aligned, the piston being distally moveable into the channel.

21. A device for insertion of a deep-in-the-canal (DIC) hearing aid into an ear canal comprising:

a base configured to fit into the conchal cavity of an ear;

a chimney projecting distally from the base, the chimney configured to fit into the ear canal and including a channel, sized to accommodate a DIC hearing aid, with an external opening;

a piston supported by a support structure such that a central longitudinal axis of the piston and a central longitudinal axis of the channel are collinearly aligned, the piston being distally moveable into the channel; and a DIC hearing aid seated in the channel such that a distal end of the hearing aid is aligned with the external opening of the channel.

22. The device of claim 21 further comprising a membrane arranged across the opening of the channel.

23. The device of claim 22 wherein the membrane is breakable when pressed with a force sufficient to eject the device distally from the channel.

24. A system for insertion of a deep-in-the-canal (DIC) hearing aid into an ear canal comprising:

a base configured to fit into the conchal cavity of an ear;

a DIC hearing aid;

a chimney projecting distally from the base, the chimney configured to fit into the ear canal and including a channel with the DIC hearing aid seated therein; and a piston supported by a support structure such that a central longitudinal axis of the piston and a central longitudinal axis of the channel are collinearly aligned, the piston being distally moveable into the channel to drive the DIC hearing aid from the channel.

25. A method of inserting a deep-in-the-canal (DIC) hearing aid into an ear canal comprising the steps of:

positioning an insertion device, with at least a majority of a DIC hearing aid seated therein, conformably within a conchal bowl of an ear; and advancing the DIC hearing aid through an opening in the insertion device deep into the ear canal.

26. The method of claim 25 wherein the step of positioning the device in the conchal bowl further comprises positioning a portion of the device into an ear canal.

27. The method of claim 26 wherein the step of positioning a portion of the device into the ear canal comprises positioning a distal end of the device into the ear canal to a depth of about 3 mm to about 5 mm.

28. The method of claim 25 wherein the method is performed by a hearing aid user.

29. The method of claim 25 wherein the method is performed by a second person assisting the hearing aid user.

30. The method of claim 25 wherein the step of advancing comprises ejecting the hearing aid to clear a distal end of the device.

31. The method of claim 25 wherein the step of advancing comprises advancing the hearing aid into the ear canal to a depth such that a distal end of the hearing aid is within about 4 mm from a tympanic membrane.

32. The method of claim 25 wherein the step of advancing comprises advancing the hearing aid into the ear canal to a depth such that a distal end of the hearing aid is about 2 mm to about 4 mm from the tympanic membrane.

33. The method of claim 25 wherein the step of advancing comprises stopping advancement of the hearing aid into the ear canal to a depth such that it does not press into a tympanic membrane.

34. The method of claim 25 wherein the step of advancing comprises resisting advancement of the hearing aid into the ear canal with a resisting force sufficient to prevent unintentional advancement; and advancing the hearing aid into the canal with a force sufficient to overcome the resisting force.

35. A method of inserting a deep-in-the-canal (DIC) hearing aid into an ear canal comprising the steps of:

positioning an insertion device, with a DIC hearing aid seated therein, conformably within a conchal bowl of an ear; and advancing the DIC hearing aid deep into the ear canal by driving the hearing aid distally with a piston.

36. The method of claim 35 wherein the step of driving the hearing aid distally with a piston comprises driving the piston with force applied by a finger.

37. A method of inserting a deep-in-the-canal (DIC) hearing aid into an ear canal comprising the steps of:

positioning an insertion device, with a DIC hearing aid seated therein, conformably within a conchal bowl of an ear;

advancing the DIC hearing aid deep into the ear canal; and breaking a membrane extending across a distal opening of the device as the DIC hearing aid advances.

38. A method of selecting an insertion device for a deep-in-the-canal (DIC) hearing aid comprising the steps of:

determining a length of an ear canal of a hearing aid user;

identifying the length of the DIC hearing aid appropriate for a user; and selecting an insertion device configured such that the insertion device will advance the DIC hearing aid into the ear canal to a position where the distal end of the DIC hearing aid is at a distance of about 2 mm to about 4 mm from the tympanic membrane.

* * * * *

UNITED STATES PATENT AND TRADEMARK OFFICE

CERTIFICATE OF CORRECTION

PATENT NO. : 8,155,361 B2
APPLICATION NO. : 12/335445
DATED : April 10, 2012
INVENTOR(S) : Robert A. Schindler It is certified that error appears in the above-identified patent and that said Letters Patent is hereby corrected as shown below:

On the title page, delete "(73) Assignee: InSound Medical, Inc., Newark, CA (US)."

Signed and Sealed this
Twenty-ninth Day of January, 2013

David J. Kappos

David J. Kappos
*Director of the United States Patent and Trademark Office*